US006125760A

United States Patent [19]

Graushar et al.

[11] Patent Number: 6,125,760

[45] Date of Patent: Oct. 3, 2000

[54] PRINTER CONVEYOR SYSTEM

[75] Inventors: William T. Graushar, Wauwatosa; John C. Geres, West Allis, both of Wis.

[73] Assignee: Quad/Graphics, Inc., Sussex, Wis.

[21] Appl. No.: 09/301,239

[22] Filed: Apr. 28, 1999

[51] Int. Cl.[7] ..... B41F 1/10

[52] U.S. Cl. ..... 101/490; 101/35; 101/38.1; 101/93.11; 400/28

[58] Field of Search ..... 101/35, 38.1, 39, 101/40, 40.1, 44, 93.11, 485, 490; 400/24, 25, 27, 28; 198/375, 378, 379, 402, 403, 405; 270/1.1, 52.3

[56] References Cited

U.S. PATENT DOCUMENTS

| | | | |
|---|---|---|---|
| 4,179,107 | 12/1979 | Harris | 270/4 |
| 4,220,081 | 9/1980 | Hawkinson | 101/93.11 |
| 4,226,324 | 10/1980 | Stocker | 198/405 |
| 4,561,352 | 12/1985 | Svyatsky et al. | 101/2 |
| 4,632,717 | 12/1986 | Graetz et al. | 156/245 |
| 5,061,100 | 10/1991 | Brouwer et al. | 400/642 |
| 5,094,554 | 3/1992 | Hurd et al. | 400/59 |
| 5,100,116 | 3/1992 | Graushar | 270/1.1 |
| 5,102,110 | 4/1992 | Reynolds | 270/1.1 |
| 5,104,105 | 4/1992 | Cote et al. | 270/1.1 |
| 5,337,669 | 8/1994 | Kanai | 101/485 |
| 5,428,375 | 6/1995 | Simon et al. | 347/12 |
| 5,467,709 | 11/1995 | Salomon | 101/93 |
| 5,467,973 | 11/1995 | Graushar et al. | 270/1.1 |
| 5,469,954 | 11/1995 | Rathert et al. | 198/412 |
| 5,642,948 | 7/1997 | Harris et al. | 400/124.28 |
| 5,647,588 | 7/1997 | Stauber et al. | 271/259 |
| 5,704,282 | 1/1998 | Khalid | 101/93.01 |
| 5,988,352 | 11/1999 | Ballestrazzi et al. | 198/405 |

*Primary Examiner*—Ren Yan
*Attorney, Agent, or Firm*—Michael Best & Friedrich LLP

[57] ABSTRACT

A method for customizing a book using a printer conveyor system which provide 100% non-contact print coverage on any portion of both covers of a book being conveyed thereon while maintaining custody and precisely registering each book prior to non-contact printing.

14 Claims, 6 Drawing Sheets

PRINTER CONVEYOR SYSTEM

FIELD OF THE INVENTION

The invention relates to printer conveyor systems and, more particularly, to printer conveyor systems which provide for 100% print coverage on any portion of the covers of books being conveyed thereon.

BACKGROUND OF THE INVENTION

It is desirable to print customized information, such as address information, on books such as magazines and catalogs. Prior art finishing printing systems which employ non-contact printing methods, such as ink jet printers, do not have ability to provide 100% print coverage to both covers on a book and in both print directions while handling the books of varying thicknesses and maintaining proper custody and precise registration of each book prior to each printing step.

SUMMARY OF THE INVENTION

The present invention provides a non-contact printer conveyor system that solves the aforementioned problems in the prior art. Specifically, the printer conveyor system of the present invention maintains custody of each book while non-contact printing customized information on each of the first and second oppositely-facing covers, and in both parallel and perpendicular to the spine directions. This enables 100% print coverage to both covers of a book. The present invention also registers the position of each book before each print step and can accommodate books of varying thickness.

The printer conveyor system of the present invention provides conveyors that carry or convey the books through each printing station. Each book is flipped as well as rotated between various printing stations to allow printing on both covers of the book and in both parallel and perpendicular to the spine directions.

It is a feature of the present invention to provide an improved printer conveyor system.

It is another feature of the present invention to provide 100% non-contact print coverage to both covers of an in-line conveyed book.

It is another feature of the present invention to maintain custody of each book as it progresses through the printer conveyor system.

It is another feature of the present invention to accommodate non-contact printing on books of varying thickness.

It is another feature of the present invention to provide precise registration of each book prior to each printing step.

Other features and advantages of the invention will become apparent to those of ordinary skill in the art upon review of the following detailed description, claims, and drawings.

Figure 1:
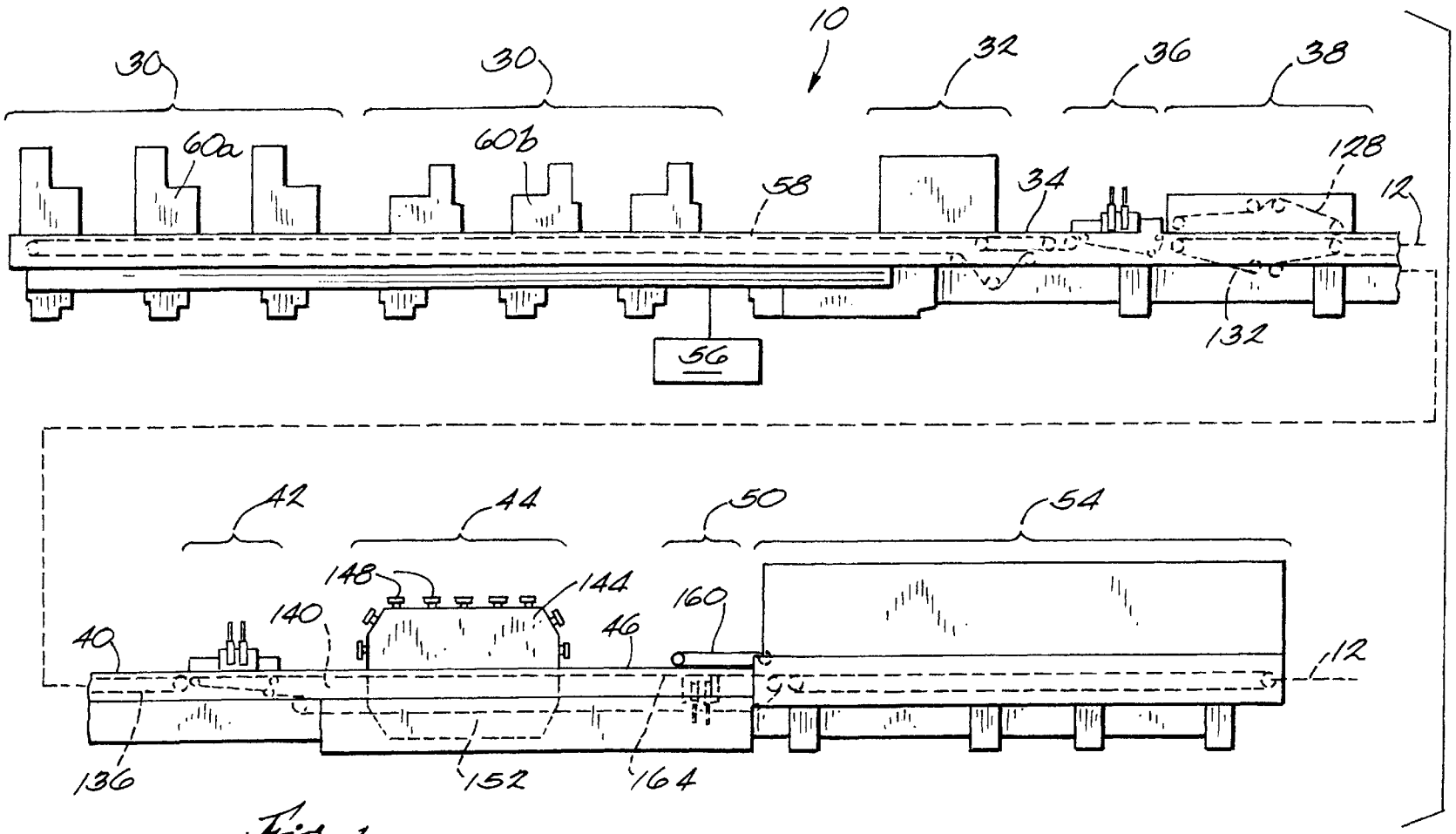
FIG. 1 is a side elevational view of a printer conveyor system embodying the present invention.

Before the preferred embodiment of the present invention is explained in detail, it is to be understood that the invention is not limited in its application to the details of construction and the arrangement of components set forth in the following description or illustrated in the drawings. The invention is capable of other embodiments and of being practiced or being carried out in various ways. Also, it is to be understood that the phraseology and terminology used herein is for the purpose of description and should not be regarded as limiting.

DETAILED DESCRIPTION OF THE PREFERRED EMBODIMENT

Referring now to the drawings, there is shown in FIG. 1 a printer conveyor system 10 embodying the present invention. The printer conveyor system 10 includes various components that are arranged adjacent a longitudinal axis 12 that defines a printing line of the printer conveyor system 10 so that the entire system 10 is an in-line system.

Figure 7:
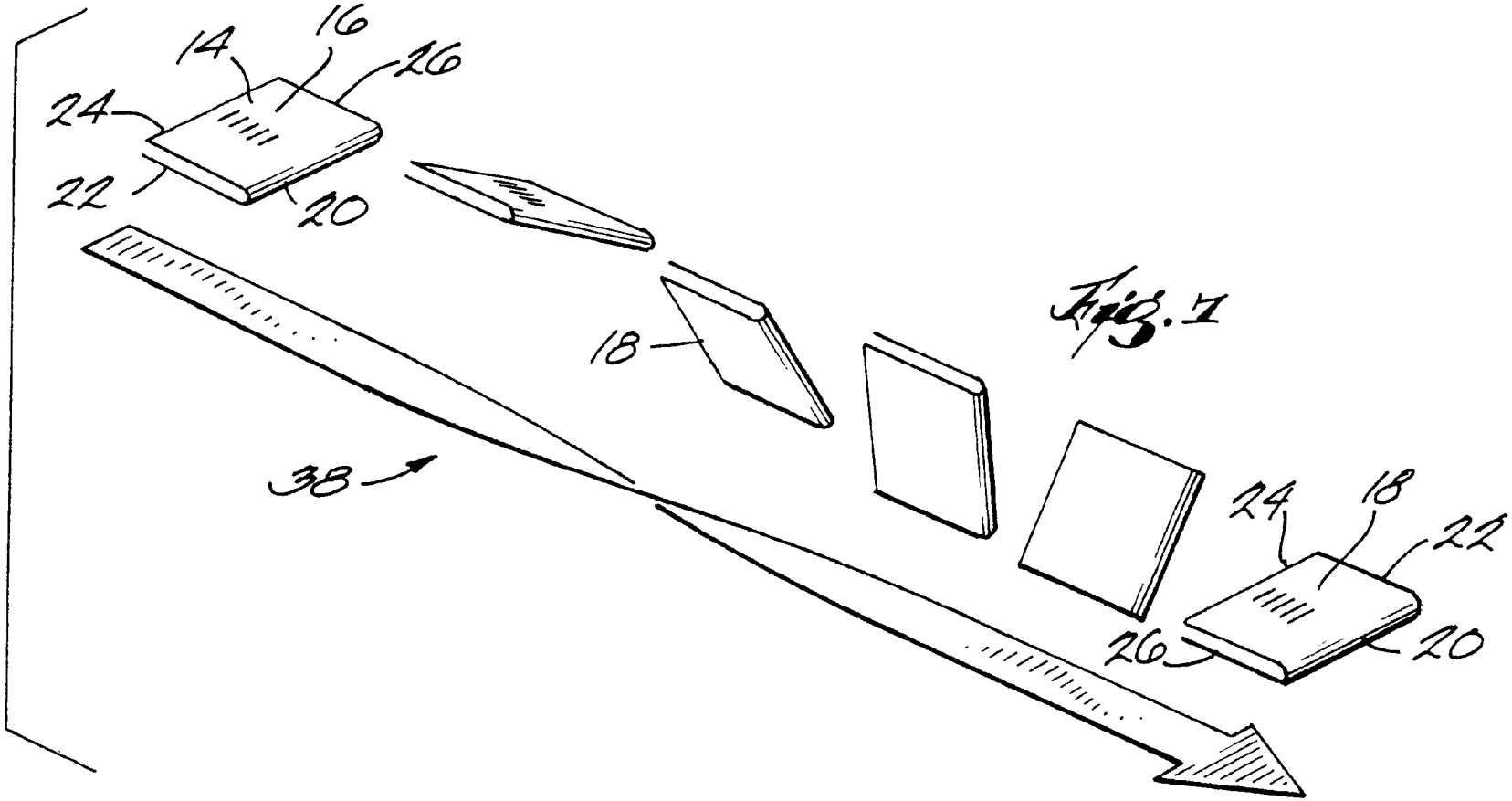
FIG. 7 is a perspective view of a book being flipped in a flipping station of the printer conveyor system.

The printer conveyor system 10 is designed to convey individual books along the axis 12 and non-contact print anywhere on either cover of each book. For reference purposes, as best shown in FIG. 7, each book 14 includes a first cover 16, an opposite-facing second cover 18, a spine 20, a head 22, a face 24, and a foot 26. The non-contact printing can be oriented either parallel to the spine 20 (perpendicular to the head 22 and foot 26) on each cover 16 and 18 as well as parallel to the head 22 or foot 26 (perpendicular to the spine 20) on each cover 16 and 18.

For purposes of definition, the term book is a printed product such as, for example, a catalog, a magazine, direct mail advertisement, and the like or could be a packaged printed product such as in a cover wrap or carton.

The components of the printer conveyor system 10 include a feeding station 30 located at a first end of the printing line, a vision station 32, a first registration station 34, a first printing station 36, a flipping station 38, a second registration station 40, a second printing station 42, a rotation station 44, a third registration station 46, a third printing station 50, a fourth printing station 54 and a controller 56.

Figure 2:
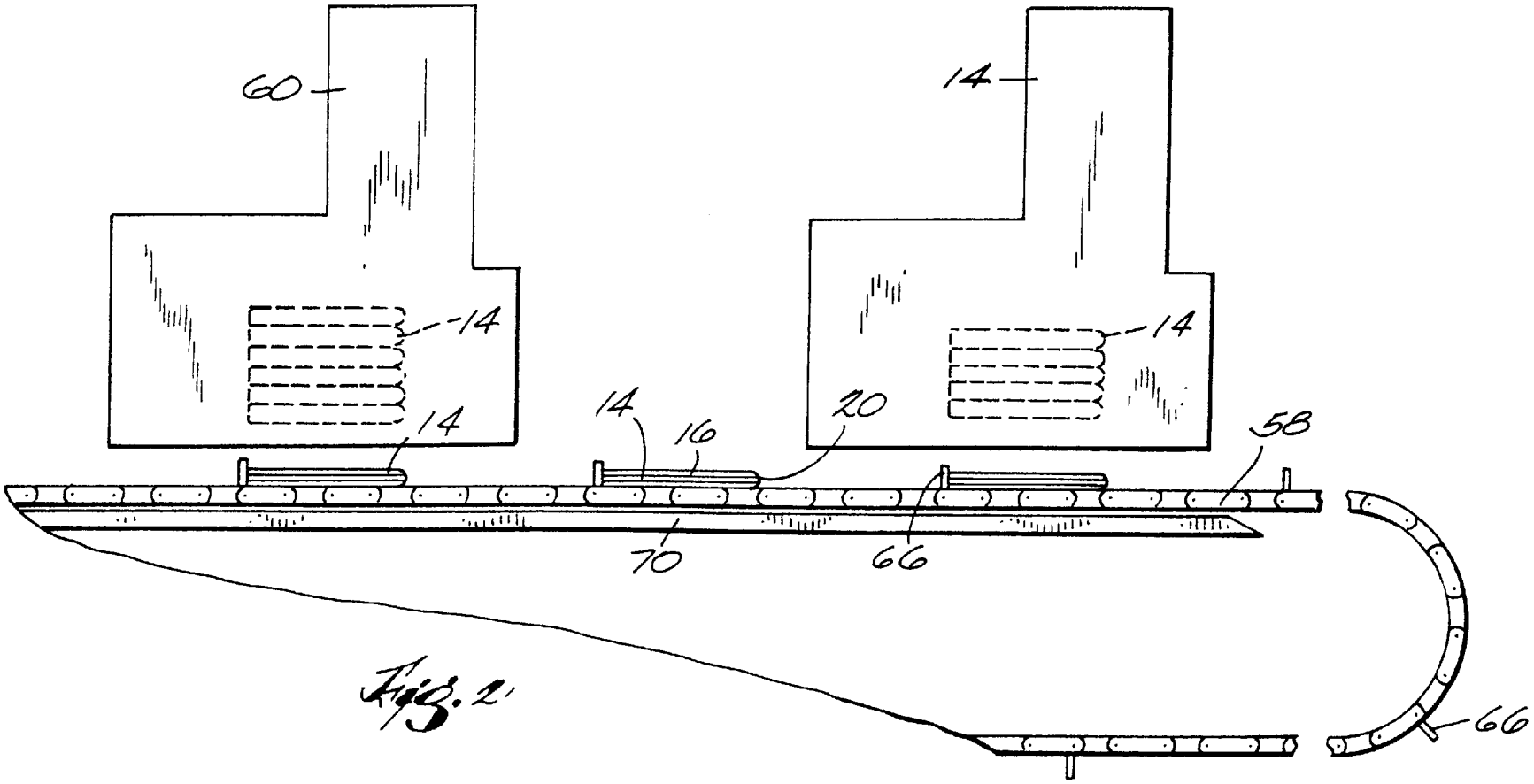
FIG. 2 is a side elevational view of a feeding station portion of the printer conveyor system.

Referring now to FIGS. 1 and 2, the feeding station 30 feeds individual books to a conveyor 58. To feed individual books to the conveyor 58, conventional feeders 60 are utilized. Two types of feeders 60 are shown as examples in FIG. 1; a rotary hopper feeder 60*a* which inverts a book through 180° before the book is dropped onto the conveyor 58 and a shuttle feeder 60*b*. Such feeders are well known in the art and the type of feeder used can vary for each book depending upon the type of book to be fed to the conveyor 58.

The feeders 60 feed books one at a time onto the conveyor 58. Briefly, each feeder 60 holds a refillable stack of books. The controller 56 is provided with subscriber information such as subscriber names, subscriber addresses, subscriber preferences and the like. As is conventionally known, the subscriber names are sorted into zip code order. Each feeder 60 is in communication with the controller 56 so that the controller 56 controls the order in which the various types of books are individually dropped on the conveyor 58 from the feeders 60 such that the books for a given zip code and postal carrier route are order sequentially along the conveyor 58.

The controller 56 is preferably a suitable programmed computer or microprocessor such as model FCS1000, FCS2000 or FCS2500 available from Quad/Tech, Inc. of Sussex, Wis.

As shown in FIG. 2, the conveyor 58 is preferably a conveyor having spaced lugs or push pins 66 however, other types of conveyors can be used. The lugs 66 ride on a lug support plate 70 under the feeders 60, causing the lugs 66 to extend above the level of the conveyor 58. The controller 56 times the release of the books from the feeders 60 such that each lug 66 pushes one book. The conveyor 58 may alternately employ one or more lugs 66 to push each book.

In the illustrated embodiment of FIG. 2, the books 14 are shown dropped onto the conveyor 58 from the feeders 60 in a spine 20 leading, cover 16 facing up orientation. However, it should be noted that the orientation of the books dropped onto the conveyor 58 from a feeder 60 can vary depending upon the location of subscriber information that will be printed on each book.

Turning back to FIG. 1, after a book has been dropped from a feeder 60 onto the conveyor 58, each book is advanced by the moving conveyor 58 to the vision station 32. Preferably, the vision station 32 includes an imaging device such as a scanner or camera mounted above the conveyor 58. For example, the camera can be either black and white or color, such cameras, which typically include vision processors, are readily available in the marketplace. The camera inspects each book on the conveyor 58 as the book passes under the camera to make sure the proper type of book was dropped onto the conveyor 58. The camera also makes sure each book is in the proper orientation; i.e. cover 16 face up and spine 20 leading. For example, if a certain type of book is intended to be oriented cover 16 facing up and spine 20 leading, the camera looks for a portion of the cover 16 or for an indicator on the cover 16. Should the camera in the vision station 32 detect an incorrect book or a proper book in an incorrect orientation, the individual book is flagged by the controller 56 and discarded at a bad book rejector portion of the printing line.

Figure 3:
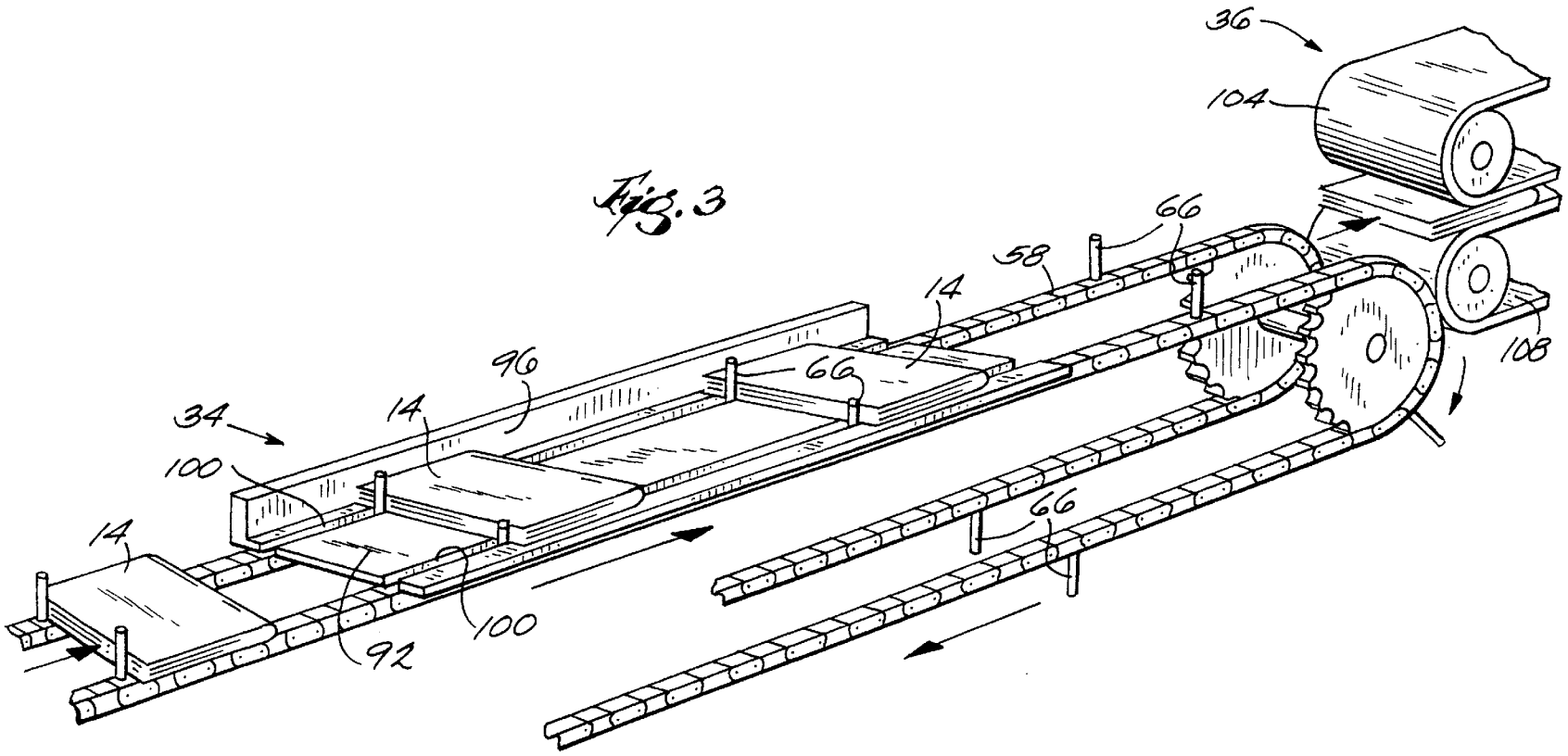
FIG. 3 is a perspective view of a registration section of the printer conveyor system.

After a book has passed through the vision station 32, the book is registered at the first registration station 34. However, it should be noted that the books could be registered before passing through the vision station 32 or registered simultaneously while passing through the vision station. FIG. 3 illustrates one type of book registration. However, it should be noted that many other types and methods of registration can be employed such as, for example, methods employing springs, gravity, or air. The illustrated registration station 34 comprises a ramp 92 and a registering plate 96. The ramp 92 is provided with a slot 100 through which each line of lugs 66 from the conveyor 58 passes to push one book. Preferably, the ramp 92 is a smooth plate having a relatively low coefficient of friction. For example, the ramp 92 can be fabricated of steel or plastic, with a Teflon coating.

In operation, each book slides down the ramp 92, under the influence of gravity, toward the registering plate 96. The registering plate 96 is used as a datum for the first printing station 36. The first registration station 34 is adapted to register each sequential book having up to a one inch difference in length, however other length differences can be selected.

Figure 4:
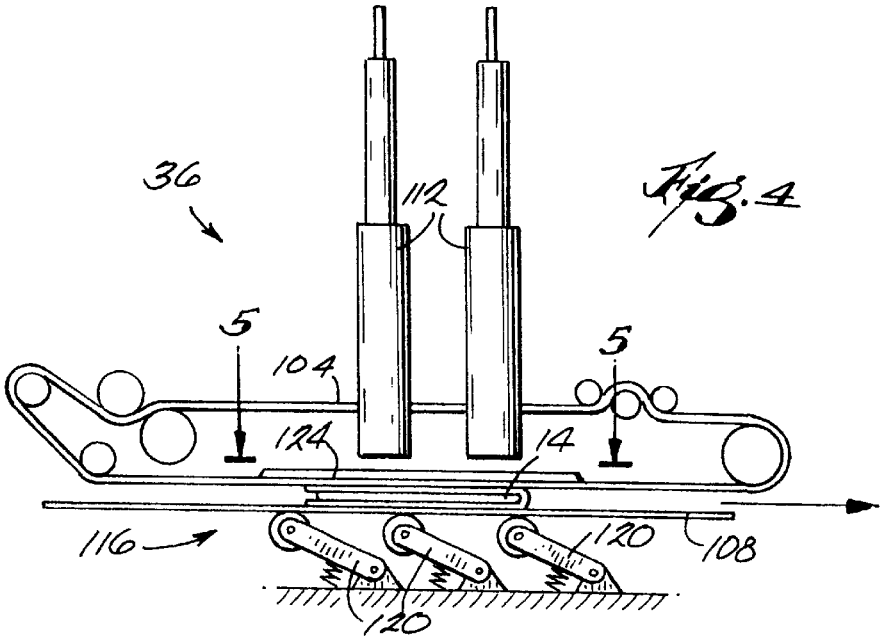
FIG. 4 is a side elevational view of a non-contact printing station.
Figure 5:
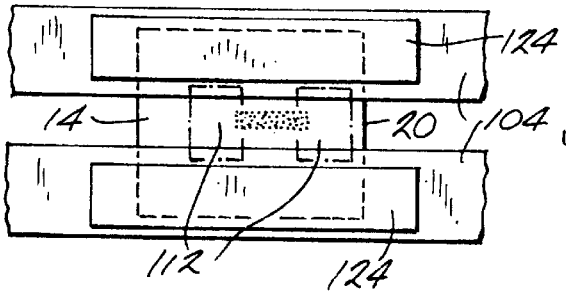
FIG. 5 is a cross-section view taken along line 5—5 in FIG. 4.

After being registered at the first registration station 34, each book is thereafter advanced to the first printing station 36. Referring now to FIGS. 4 and 5 in particular, a top belt conveyor 104 and a bottom belt conveyor 108 are disposed adjacent the conveyor 58 such that the conveyors 104 and 108 gain custody of each book as a book reaches the end of the conveyor 58 (FIG. 3). The first printing station 36 may include a conventional ink jet printer or other non-contact printing head 112 that is in communication with the controller 56. The first printing station 36 could also include an all points addressable (APA) type of ink jet printer as are commercially available.

The printing station 36 further includes a book leveler 116. The book leveler 116 includes a plurality of spring-loaded rollers 120 that act to push each book upwardly against a pair of guide rails 124. The guide rails 124 are held at a fixed distance from the printing head 112. The fixed distance is set to an optimal distance for non-contact printing. An example of one type of book leveler that can be utilized is that disclosed in U.S. Pat. No. 5,467,973, issued to Quad/Tech, Inc., which is herein incorporated by reference.

Regardless of the variance in thicknesses of the types of books to be processed by the printer conveyor system 10, each book 14 will be held the optimal distance from the printing head 112 to maintain quality printing. The printing head 112 is designed to print subscriber information at a high rate of speed to keep up with the speed that the books are moving through the printer conveyor system 10.

In the illustrated embodiment, the printing head 112 of the first printing station 36 prints on the cover 16 of a book 14 parallel to the direction in which the book is advancing; i.e. parallel to the head 22 and foot 26 of the book. However, it should be noted that the first printing station 36 can be configured to print subscriber information parallel to the spine 20 or, if the book is fed onto the conveyor 58 with the cover 18 facing up, print in either orientation of the cover 18.

Referring now to FIGS. 1 and 7, after each book has passed through the first printing station 36, each book enters the flipping station 38. The flipping station 38 includes a top conveyor belt 128 and a bottom conveyor belt 132. The belts 128 and 132 are disposed adjacent the first printing station 36 such that the belts 128 and 132 take custody of each book as a book reaches the end of the first printing station 36. The belts 128 and 132 are twisted 180° degrees to therefore cause each book to flip or rotation 180° degrees as it travels through the flipping station 38 so that the opposite cover, cover 18 in the illustrated example of FIG. 7, ends face up.

In the preferred and illustrated embodiment, each book 14 is fed into the flipping station 38 in a spine 20 leading orientation to prevent flutter. When each book emerges from the flipping station 38, the books remain in a spine 20 leading orientation with the second cover 18 facing up.

A second drop-lug conveyor 136 takes custody of each book as a book emerges from the flipping station 38. The conveyor 136 is similar to the conveyor 58. The conveyor 136 advances each book through the second registration station 40 and to the second printing station 42.

The second registration station 40 is similar to the first registration station 34 and is used to register each book prior to a book entering the second printing station 42. In the described embodiment, the print head of the second printing station 42 prints on the cover 18 of each book in a direction parallel to the direction of travel of the book, in other words, parallel to the head 22 or foot 26 of the book.

A third drop-lug conveyor 140 takes custody of each book as it emerges from the second printing station 42. The conveyor 140 is similar to the conveyor 58, and extends from the second printing station 42 to the rotation station 44.

Figure 6:
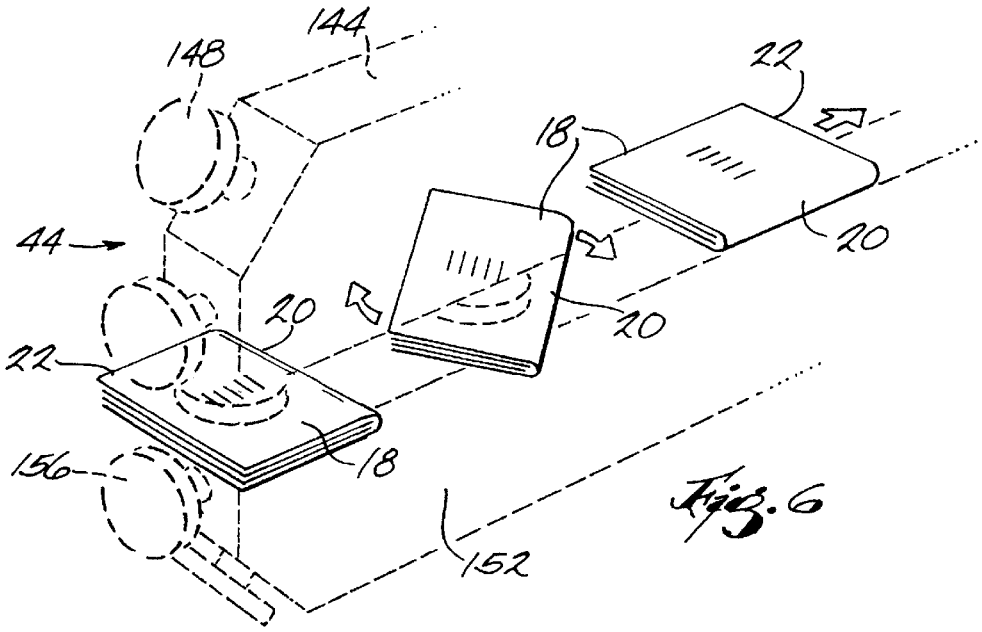
FIG. 6 is a perspective view of a rotating station of the printer conveyor system.

Referring now to FIG. 6, the rotation station 44 includes a top conveyor 144 having pressure members or feet 148 and a bottom conveyor 152 having pressure members or feet 156. The feet 148 and 156 are spaced to sandwich each book 14 therebetween as a book reaches the end of the conveyor 140.

In the illustrated embodiment, the feet 148 press down on the cover 18 and the feet 156 press up on the cover 16. Each book is advanced under the power of the conveyors 144 and 152. The bottom conveyor 152 is driven by the conveyor 144 through friction transferred through each book. The feet 148 are mounted in bearings so as to be free floating. The feet 156 are cam driven so as to rotate 90°, thereby also rotating the feet 148 and the book therebetween. As shown in FIG. 6, each book 14 exits the rotation station 44 in a head 22 leading orientation. An example of a rotation station 44 is model TRC available from Prim-Hall Enterprises, Inc. of N.Y.

The third registration station 46 is similar to the first registration station 34. Each book passes through the third registration station 46 and then enters the third printing station 50, which is similar to the first and second printing stations 36 and 42. In the illustrated embodiment, print head at the third printing station 50 is disposed below the elevation of the books so that information is printed on the cover 16. In the illustrated embodiment, the print head of the non-contact printer prints upwardly onto the first cover 16 and parallel to the spine 20. However, it should be noted that alternatively, if a printer is to be used that does not have the ability to print upwardly, a book flipper can be utilized prior to the third printing station 50.

After each book has passed through the third printing station 50, the books enter the fourth printing station 54. In the fourth printing station 54, one or more paper labels may be applied to the second cover 18 of the book 14 if a knock-out has not been provided. Such labels can be applied with any type of adhesive such as permanent or removable adhesives. At this printing station 54, a subscriber address is preferably printed on either the paper label or directly on the second cover 18 of the book 14.

In this printer conveyor system 10, the custody of the books is maintained throughout the entire printing line in that the controller 56 knows where each book is at all times. Any book traveling along the printing line can be identified and located by the controller 56 at any given moment.

Figure 8:
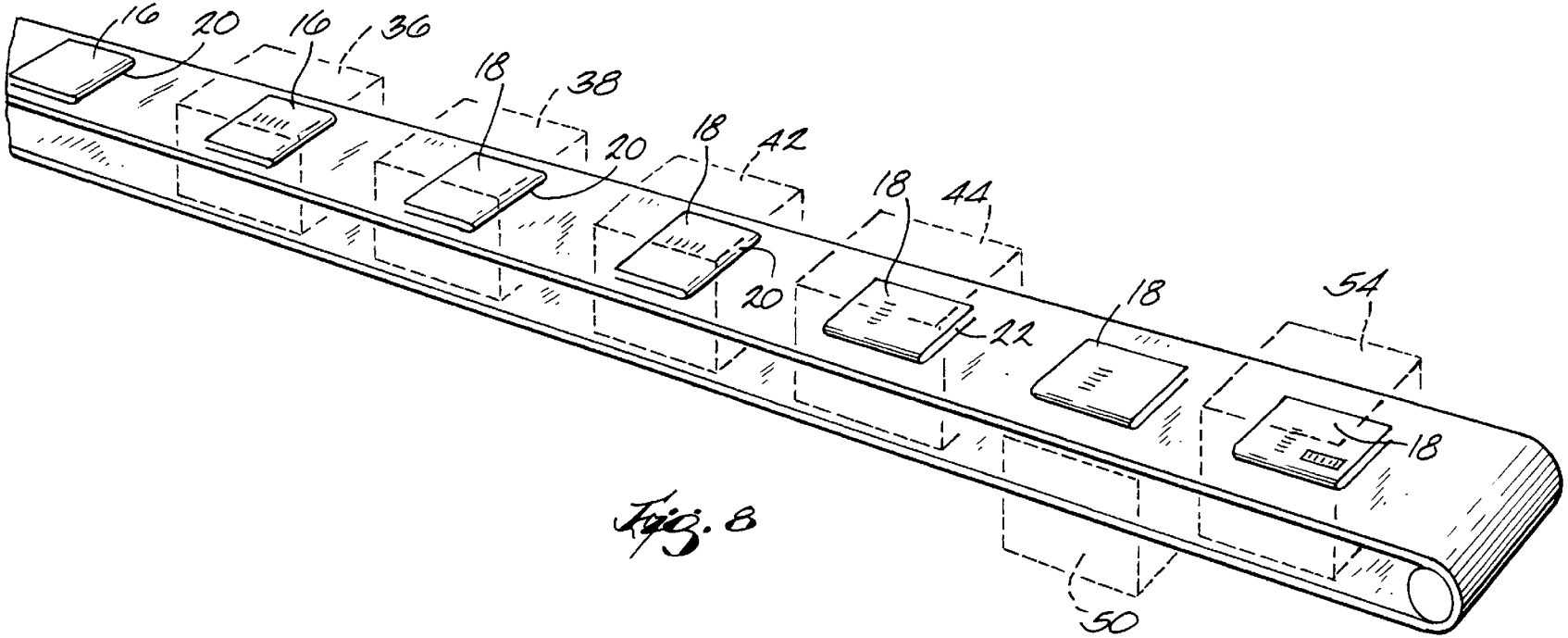
FIG. 8 is a perspective schematic view of the various orientations that a book may travel through the printer conveyor system.

Each book can exit the printer conveyor system 10 with personalized subscriber information printed on both covers 16 and 18 and in both parallel and perpendicular to the spine 20 directions, if desired. FIG. 8 illustrates schematically one such arrangement. Typically, 100% coverage may not be necessary for each type of book. However, the invention enables flexibility in what areas of both covers of each type of book subscriber information is to be printed upon. With each type of book typically varying in cover layout, the printer conveyor system 10 provides one in-line printing line that can accommodate wherever on various types of book, information needs to be printed.

It should be noted that the printing stations 36, 42, 50 and 54, the rotation station 44, and the flipping station 38 are module in nature, and may be arranged in a multitude of orders other than the illustrated embodiment. For example, the rotation station 44 may be positioned between the first and second printing stations, and the flipping station may be positioned between the second and third printing stations. Further, for example, the printing stations can be positioned above or below the elevation of the printing line to enable printing on either cover 16 or 18. The invention provides the flexibility to order these various components in various ways to accommodate the desired print requirements.

It should also be noted that the controller 56 controls what information is printed on each individual book. In this regard, each book is customized for the individual to whom the book is addressed. Accordingly, some books will be printed upon at a given printing station while others will not. Therefore, at each printing station, there will be a group of books that are printed upon and a group that are not printed upon. However, in most cases each book will have a mailing address printed one of its covers at one of the printing stations.

We claim:

1. A method for customizing a book having a spine and substantially opposite-facing first and second covers, the method comprising the steps of:

(a) selectively printing on the first cover in a direction substantially parallel to the spine;

(b) selectively printing on the second cover in a direction substantially parallel to the spine;

(c) selectively printing on the first cover in a direction substantially perpendicular to the spine;

(d) selectively printing on the second cover in a direction substantially perpendicular to the spine; and (e) maintaining custody of the book with an in-line automated apparatus during steps (a)–(d).

2. The method of claim 1, further comprising the step of rotating the book prior to at least one of steps (a) through (d).

3. The method of claim 1, further comprising the step of flipping the book prior to at least one of steps (a) through (d).

4. The method of claim 1, further comprising the step of registering the book prior to at least one of steps (a) through (d).

5. The method of claim 1, further comprising the step of selectively adjusting the distance between one of the first and second covers and a print head prior to at least one of steps (a) through (d) to optimize the print quality.

6. The method of claim 1, wherein step (b) follows step (a), step (c) follows step (b), and step (d) follows step (c), the method further comprising the steps of:

registering the book prior to each of steps (a) through (d);

selectively adjusting the distance between one of the first and second covers and a print head prior to each of steps (a) through (d);

flipping the book between steps (a) and (b);

rotating the book between steps (b) and (c); and printing an address on at least one of the first and second covers during one of steps (a) through (d).

7. The method of claim 6, further comprising the step of selectively feeding the book into the in-line automated apparatus prior to step (a) according to the address to which the book is intended to be sent.

8. A method for customizing a book for mailing, the method comprising the steps of:

(a) selectively printing on a first cover of the book in a direction substantially parallel to a spine of the book;

(b) selectively printing on the first cover in a direction substantially perpendicular to the spine;

(c) selectively printing on a second cover of the book in a direction substantially parallel to the spine;

(d) selectively printing on the second cover in a direction substantially perpendicular to the spine; and (e) maintaining custody of the book with an in-line automated apparatus during steps (a) through (d);

whereby one of steps (a) through (d) includes printing an address on one of the first and second cover.

9. The method of claim 8, further comprising the step of rotating the book prior to at least one of steps (a) through (d).

10. The method of claim 8, further comprising the step of flipping the book prior to at least one of steps (a) through (d).

11. The method of claim 8, further comprising the step of registering the book prior to at least one of steps (a) through (d).

12. The method of claim 8, further comprising the step of selectively adjusting the distance between one of the first and second covers and a print head prior to at least one of steps (a) through (d) to optimize the print quality.

13. The method of claim 8, wherein step (b) follows step (a), step (c) follows step (b), and step (d) follows step (c), the method further comprising the steps of:

registering the book prior to each of steps (a) through (d);

selectively adjusting the distance between one of the first and second covers and a print head prior to each of steps (a) through (d);

rotating the book between steps (a) and (b);

flipping the book between steps (b) and (c); and printing an address on at least one of the first and second covers during one of steps (a) through (d).

14. The method of claim 13, further comprising the step of selectively feeding the book into the in-line automated apparatus prior to step (a) according to the address to which the book is intended to be sent.

* * * * *